United States Patent [19]

Aime et al.

[11] Patent Number: 4,580,407

[45] Date of Patent: Apr. 8, 1986

[54] HEATING DEVICE OF A FLUID THAT INCLUDES AN ABSORPTION HEAT PUMP CYCLE

[75] Inventors: Christian Aime, Epinay sur Seine; Bernard Genest; Claude Junet, both of Paris; Paul Moffroid, Montigny les Cormeilles, all of France

[73] Assignee: Gaz de France, Paris, France

[21] Appl. No.: 649,637

[22] Filed: Sep. 12, 1984

[30] Foreign Application Priority Data

Sep. 12, 1983 [FR] France ..... 83 14483

[51] Int. Cl.[4] ..... F25B 15/00

[52] U.S. Cl. ..... 62/148; 62/238.3; 62/476; 62/497

[58] Field of Search ..... 62/148, 476, 497, 238.3

[56] References Cited

U.S. PATENT DOCUMENTS

| | | | |
|---|---|---|---|
| 2,250,288 | 7/1941 | Ashby | 62/497 |
| 2,290,532 | 7/1942 | Buffington | 62/476 |
| 3,000,196 | 9/1961 | Kogel | 62/497 X |
| 3,177,675 | 4/1965 | Kogel | 62/148 |
| 3,253,421 | 5/1966 | Grubb | 62/148 |
| 3,367,137 | 2/1968 | Whitlow | 62/148 X |
| 3,407,625 | 10/1968 | McDonald | 62/148 X |
| 3,839,849 | 10/1974 | Maniya | 62/238.3 X |

FOREIGN PATENT DOCUMENTS

| | | |
|---|---|---|
| 2648855 | 4/1978 | Fed. Rep. of Germany . |
| 3018708 | 5/1980 | Fed. Rep. of Germany . |
| 2913066 | 10/1980 | Fed. Rep. of Germany . |

*Primary Examiner*—Lloyd L. King

*Attorney, Agent, or Firm*—Pollock, VandeSande & Priddy

[57] ABSTRACT

The invention pertains to improvements brought to a heating facility which includes an associated absorbing heat pump cycle.

The facility is designed for direct thermosiphon heating of the absorption solution to be regenerated upon contact with a panelling (15) which surrounds the combustion chamber (9). The separation of the solution to be regenerated is performed inside a separation column (14) which is connected to a dephlegmator (16) which improves the yield of the separation, the yield of the absorbing cycle and the recovery yield of heat supplied by the burner. Furthermore a heat exchanger (8) enables the operation of the facility with a de-activation of the absorbing cycle. The invention applies especially to central heating and to the heating of hygienic water.

7 Claims, 6 Drawing Figures

HEATING DEVICE OF A FLUID THAT INCLUDES AN ABSORPTION HEAT PUMP CYCLE

BACKGROUND OF THE INVENTION

This invention pertains to improvements brought to a heating device equipped with an absorption heat pump.

In some devices for heating a liquid, like water for instance, and especially for heating buildings and producing hygienic hot water, facilities which include at least one solid, liquid and/or gaseous fuel burner that releases "vapors" at a fairly high temperatures, we sometimes use an absorption heat pump in order to improve the thermal yield of the heating.

Usually, in such a case, the burner is used to heat the absorption solution that was used in the absorption cycle of the heat pump so as to separate the constituents of the solution and regenerate the absorption liquid that was used in the cycle.

At the vapor/absorption solution heat exchange level, the yield is mediocre since, in view of conditions underlying the thermal exchange, the vapors leave the facility at a usually high temperature which exceeds 200 degrees C which conveys to the chimney vast amounts of energy that are wasted.

In most instances this unfavorable situation is tolerated because at the level of the heat pump cycle we recover in the ambient environment at the level of the evaporate cycle significantly move energy than we allowed to escape through the chimney, so that the overall yield for the facility seems fairly decent. However, this is only the case if operating conditions for the evaporator are satisfactory, or usually if the "cold source" level, in which the heat is "pumped" that is released to the facility is sufficiently high. This well-known phenomenon encourages the installers to set up in parallel upon the heating facility a conventional boiler which will heat directly the liquid to be heated when the operating conditions of the cold source become unfavorable (usually in cold weather and especially if the evaporator borrows its heat from the ambient air).

In order to cut down the heat losses from the chimney, the suggestion was also made to place heat recovery exchangers on the vapor circuit, said recovering exchangers will be in a thermal exchange mode with the liquid to be heated. However, practically speaking, these exchangers are not satisfactory, basically for the following two reasons.

(1) The additional cost for installation that their use entails is not economically sound;

(2) setting-up exchange circuits, which requires long ducts means so that we lose most of the heat that we tried to recover anew through line losses in those ducts.

In the prior patent application No. 82 19510 which was filed on Nov. 22, 1982 by the same applicant, we recommended a perfected facility which made it possible to resolve some of the displayed difficulties.

In this regard, in the prior application, the exchanger for a heat pump boiler includes two series installed levels, the first acting as a boiler for the purpose of raising that absorbing solution to a proper temperature, the second acting as a recuperator for the purpose of reheating the heating liquid in the vicinity of its input into the facility. Both exchangers are originally comprised of two series placed twin barrels, the lower barrel of the two twin barrels acting as an output passage for the vapor that is generated inside the combustion chamber of the facility. Furthermore, a branching is anticipated at the level of the first exchanger where the solution to be regenerated leaves that exchanger after being heated, this branching leading into a separator flask inside which the separation of the volatile enhanced solution is performed from the weakened, heavier solution for use of the two separated solutions in the absorbing cycle of the facility.

BRIEF DESCRIPTION OF THE INVENTION

This invention uses the general principles of this prior application to which it adds specific improvements that ensure a more "performing" implementation and greater flexibility of use.

To this end, a heating facility for a liquid like water for instance, especially for heating buildings and producing hygienic hot water in conformance with the invention, of the kind that includes at least one solid, liquid and/or gaseous fuel burner which produces "vapors" at a fairly high temperature which includes a first exchanger for a heat pump burner and a second recuperator exchanger that is series arranged with the first one and that is used to heat said liquid, said first exchanger communicates with a separator inside which the separation takes place of "distillate" and "residue" from the absorbing solution to be regenerated after working in the cycle of the facility, is characterized in that said burner includes a combustion chamber in contact with which a panelling is placed that communicates directly with the part of the separating column that acts as the previously mentioned separator, said column being placed right above and inside which the returns are inserted from the absorbing solution to be regenerated. For the sake of test comprehension, we shall hereinafter call "distillate" the more volatile part or "enhanced" solution of the absorbing solution after its regeneration and "residue" the heavior part that comprises the "weakened" solution of the absorbing solution after its regeneration.

By functioning in the manner mentioned above, we improve substantially the operating conditions of the facility because not only is the recovery of heat improved at the level of the burner to the benefit of the facility, but also, the temperature of the absorbing solution is raised to be regenerated which simultaneously improves the effectiveness of separation, hence the thermal yield of the absorbing cycle.

Advantageously, said panelling is divided into two contiguous chambers, the first one inside which said returns of the solution to be regenerated are admitted before being inserted inside said separation column, the second one which communicates directly with the solution that is found at the base of said column through at least one wide opening which favors thermal exchanges through a thermosiphon, such a concept of assembly, based on a simple technique, obviously and automatically ensuring excellent homogeneous heating of the absorbing solution to be directly regenerated at the level of the base of the separation column.

BRIEF DESCRIPTION OF THE DRAWINGS

Other characteristics, subjects and advantages of the invention will seem clearer with the description that follows in reference to attached drawings wherein.

DETAILED DESCRIPTION OF THE INVENTION

Figure 1:
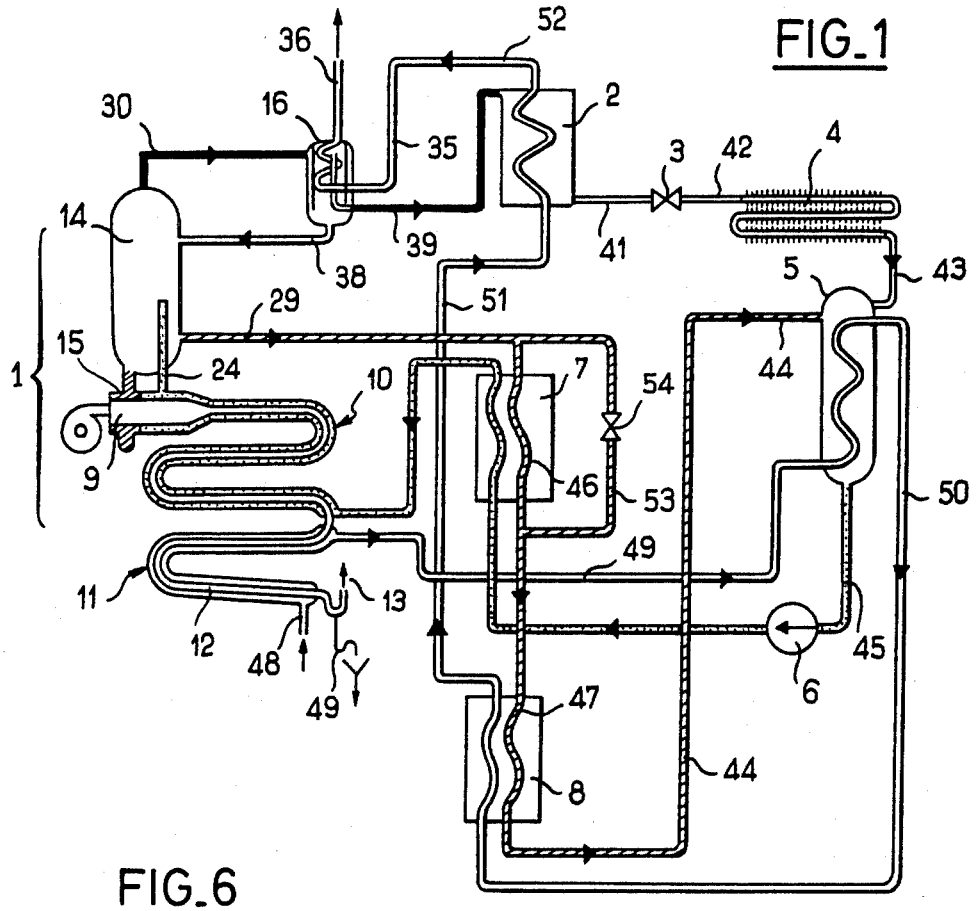
FIG. 1 is an overall scheme of a facility designed according to the invention.

First of all we will refer to FIG. 1 which illustrates the overall scheme of a facility designated according to the invention.

According to this scheme, the facility basicallycomprises the cycle of the absorbing pump which includes the boiler-regenerator 1, the condenser 2, the pressure reducing valve 3, the evaporator 4, the absorber 5, a circulation pump 6 for the solution, a heat exchanger 7 and an additional exchanger 8.

The boiler regenerator 1 is basically comprised of a burner in its combustion chamber 9 which includes subsequently two heat exchangers respectively 10 and 11 that are comprised of two series assembled twin barrels, the inner barrel 12 common to the two exchangers travelled by the vapors produced inside the combustion chamber 9 that escape at 13 through the chimney 13 (not depicted).

The boiler regenerator 1 also includes a separation column 14 that receives after they are heated especially in the heat exchanger 10 and at the level of part 20 of the panelling 15 that surrounds the combustion chamber 9, returns of solution to be regenerated that comes from the absorber 5. The boiler regenerator 1 also includes a device which is known as a dephlegmator 16 which accommodates the distillates that are produced at the fore of the separation column 14 for their drying in order to improve the yield of the absorbing cycle.

Figure 2:
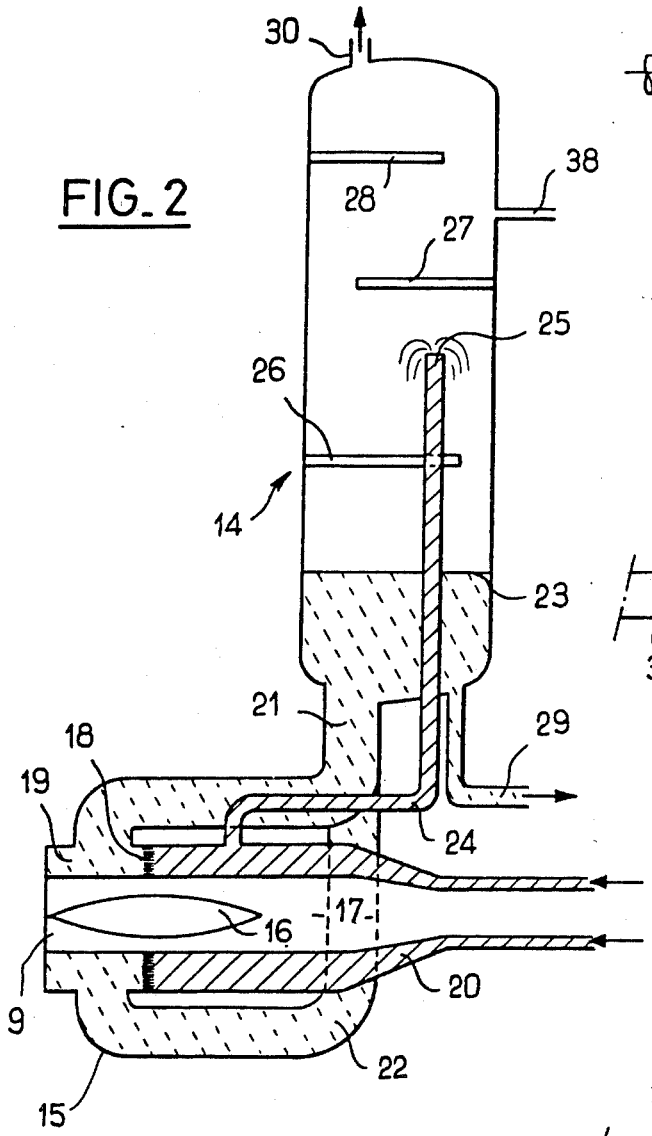
FIG. 2 depicts in more detailed fashion part of the facility which includes the burner and the separation column.
Figure 3:
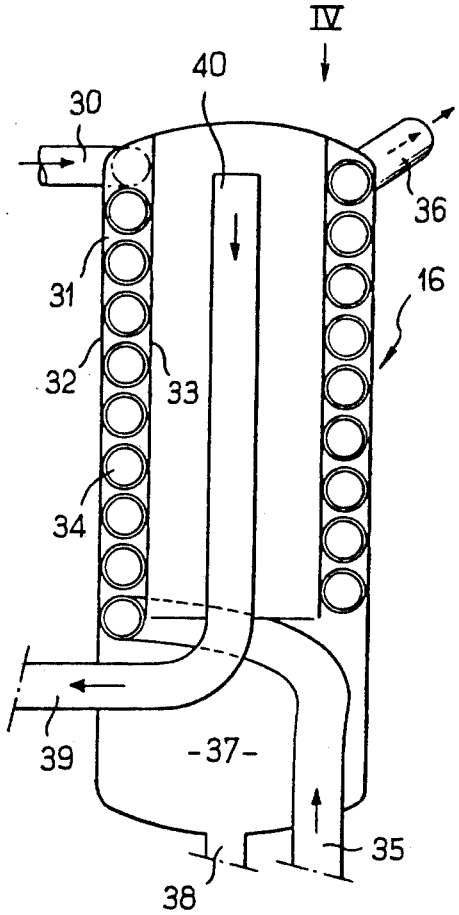
FIG. 3 is a vertical sectional view that depicts one of the parts of the facility which comprises the "dephlegmator"
Figure 4:
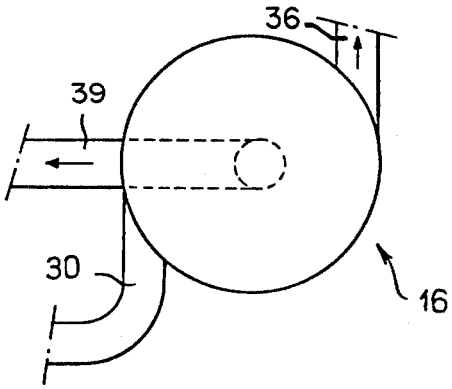
FIG. 4 is a view from above performed according to arrow IV of FIG. 3.

Following this overall description of the facility, we will now refer to FIGS. 2, 3, and 4 with which we will describe in more detail some of the particular instruments which are used in the facility.

By referring first to FIG. 2, we will describe the construction of the burner 9 that is surrounded by its panelling 15 in connection with the separation of column 14.

The burner (which is not depicted) of which we only illustrated the flame at 16 includes a combustion chamber 17 that is surrounded by a panelling 15. In the illustrated implementation example, the panelling 15 is divided by a wall 18 into two chambers respectively 19 and 20. The chamber 19 communicates with the base of the column 14 through two ducts with a fairly significant section 21, 22. In this manner, under the effect of heating which takes place inside the combustion chamber 17 there develops more effective thermosiphon circulation of the solution to be regenerated that is present up to level 23 in the column 14. Thus, we obtain proper homogenizing of the temperature of the solution to be regenerated inside the column 14.

Most of the panelling 20 that surrounds the combustion chamber 17 accommodates, as it will appear more clearly later, the returns of the absorbing solution stemming from the absorber 5 after they have crossed through the heat exchanger 10 for admittance through the duct 24 into the column 14. In this manner we obtain more effective heating at a higher temperature of the absorbing solution which improves the regeneration process the quality of which depends mostly on the yield of the absorbing cycle.

As it will appear in FIG. 2, the duct 24 leads through its upper orifice at 25 more or less at mid-height of the column 14, which includes a number of baffles 26, 27, 28 acting as simplified distilling plates inside that column. A more effective separation is thus obtained between the "distillate" and the "residue" that are separated inside the column from the absorbing solution stemming from the absorber 5. There is also reduced dredging of fractions of liquid residue by distillate that are shaped like fine droplets.

The liquid residue comes out of the separation column through duct 29 at the column base, while the distillate comes out from the top of the column through duct 30.

Now we will refer to FIGS. 3 and 4 in order to describe the implementation of the "dephlegmator".

The distillates which come out of the column 14 through the duct 30 enter the dephlegmator 16 at the upper section of a volume 31 that is lodged between the circular cylindrical vertical wall 32 of the dephlegmator 16, and a more inner concentric wall 33. Inside the volume 31 there is also a helical coil 34 inside which the fluid to be heated, used as cooling liquid, circulates as shown by the arrows, which penetrates inside the dephlegmator through duct 35 and exits through duct 36 which acts as the heating start-up of the facility.

The distillates which are introduced at 30 inside the dephlegmator therefore are channelled according to a peripheral helicoidal trajectory which descends at counter-current with the liquid to be heated that goes along the helical coil 34 and that head towards the base of the apparatus inside the volume referred to as 37. The distillates are therefore subjected both to a centrifuging effect and a cooling effect that tend to condense the residue parts which are conveyed with the distillates and separate them from the lighter distillates. Under these circumstances, the condensed residues escape from the dephlegmator through duct 38 which is located at the base of the device while the gaseous distillates escape from the device through duct 39 of which the outlet is located at 40 at the upper section of the device.

As it is shown in FIG. 1 the residues which are separated and collected at 38 inside the dephlegmator are returned to the separation column 14 towards the upper section of that column. In this manner, we signficantly improve the separation of the absorbing solution into its light distillates and heavy residues, which improves the operation of the absorbing cycle.

Figure 6:
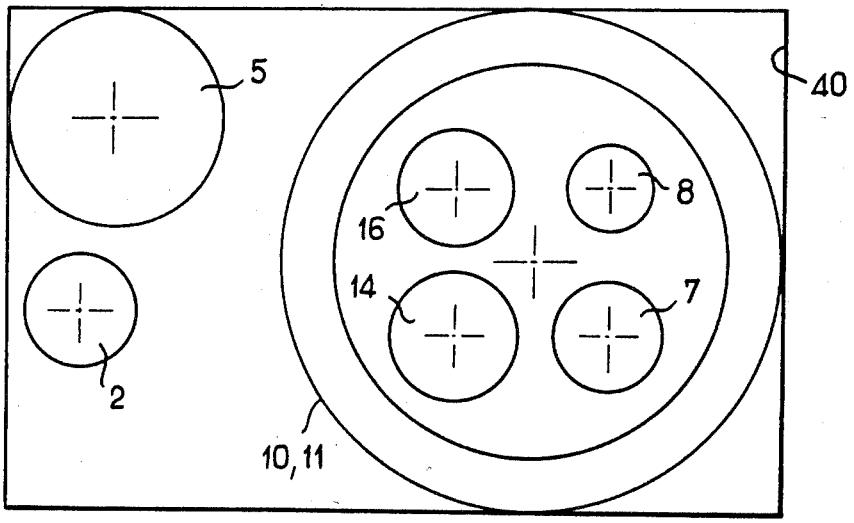
FIG. 6 depicts in a view from above and schematically the installing of various organs of the facility that are visible in FIG. 5.
Figure 5:
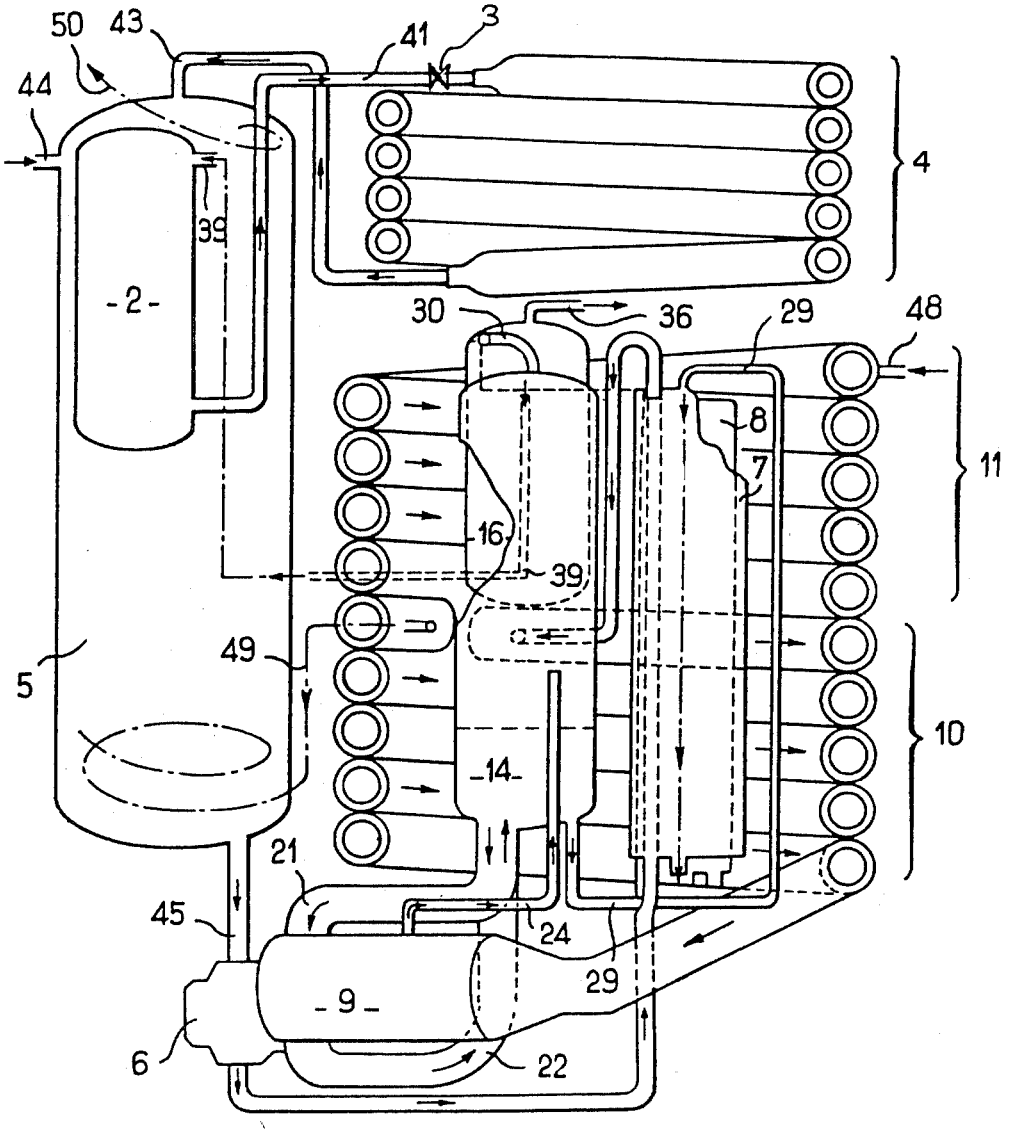
FIG. 5 depicts schematically in a view from the front with partial bursts a preferred regrouping mode of the main elements of the facility.

When we refer now to FIGS. 5 and 6, were realize an especially efficient installation at the thermal level, which is convenient from the standpoint of compactness of the facility.

We see that the separation column 14, the dephlegmator 16, the heat exchangers 7 and 8 were all housed inside the two twin barrel propellers which comprise the heat exchanger 10 for the boiler of the heat pump and the heat exchanger 11, which acts as the heat recuperator for the liquid to be heated. In this manner the thermal exchanges are improved inside the facility.

The absorber 5 and the condenser 2 are found outside of the exchangers 10, 11; the overall facility, excluding the evaporator 4 can be housed inside a casing which acts as the outer sheathing (not depicted).

By referring now especially to FIGS. 1 and 5, we will describe the operation of the facility and the various circulation circuits.

(1) Circulation of distillates acting as the calogenous liquid

The distillates are produced according to what was stated above inside the separation column 14 from the absorbing solution stemming from the absorbing column 5. The distillates escape from the top of the column 14 through duct 30 and penetrate inside the dephlegmator 16. After crossing into the dephlegmator which ensures centrifuging and couner-current cooling with the liquid to be heated, the distillates which are rid of their "dampness" (the heavy parts of "residue" that are dredged being returned to the column 14 through duct 38) are conveyed through duct 39 inside the condenser 2 which is cooled at counter-current by the circuit of liquid to be heated inside which condensing takes place. The condensed distillates are admitted through duct 41 inside the pressure reducing valve 3 wherein their reduction and consecutive cooling take place. They are re-heated inside the evaporator 4 which can be an air exchanger which exchanges heat with the ambient environment or for instances a water/exchanger/which exchanges heat with residual water. It is known that at this level of the device, there takes place heat borrowing from the outer environment. The distillates which are thus reduced and re-heated at the output of the evaporator 4 penetrate through duct 43 on top of the absorbing column 5. In that column, the distillates are absorbed by the heavy residues which are conveyed through the duct 44 inside the absorber and with which they mix by releasing heat, which is partly exchanged with the liquid to be heated as it will be described later in relation to the circuit. The mixed solution leaves the absorber through duct 45 from which it is recovered by the pump 6 in order to be brought back after having crossed the heat exchanger 7 in counter current with the hot residues from column 14, before penetrating inside the exchanger 1 then in the chamber 20 which is present around the combustion chamber 17 prior to being introduced into the separation chamber 14 through duct 24.

(2) Circulation of residues

The residues from the absorbing cycle which leave the base of the column 14 through duct 29 are conveyed through a circuit referred to as 46 inside the exchanger 7 at counter-current with the solution to be regenerated which they re-heat. Following which, the residues cross through duct 47 inside the additional heat exchanger 8 which is cooled at counter current by the circuit of liquid to be heated. At the output of the exchanger 8 the cooled residues penetrate through duct 44 at the top of the absorbing column 5 to blend with the distillates that are conveyed to the column through duct 43.

(3) Circulation of liquid to be heated

The cold input of liquid to be heated, which can comprise for instance the cold returns of central heating, takes place at 48 at the end of the exchanger 11 through which the vapors 13 of the facility are evacuated. At 49 we have the evacuation of condensates which stem from the vapors, the temperature of the cool returns usually making it possible to recover at least a substantial part of the vapor condensation heat.

At the output of the exchanger 11 the heating liquid reaches the absorber 5 through a duct 49, which enables optimal cooling of the condensates thus improving the operating conditions of the absorbing cycle. After the absorber 5, the heating liquid is conveyed through a duct 50 inside the heat exchanger 8, which in the usual operating position of the facility which has been described up to now makes it possible to recover part of the heat from the residues before they enter the absorbing column 5. At the output of the exchanger 8, the liquid to be heated reaches the condenser 2 through duct 51 inside which most of the intake of heat is achieved through the absorbing circuit. At the output of the condenser 2, the fluid to be heated reaches the dephlegmator 16 through duct 52 inside which a last heating operation takes place, which makes it possible as it has been described earlier to improve the purge and separation between light distillate and heavy residue of the absorbing solution at the output of the absorbing column 5.

When the operating conditions of the absorbing cycle are not favorable, or for instance when the temperature of the cold source from which the external heat is borrowed, is too low, we can stop the operation of the absorbing cycle, or the operation of the dephlegmator 16, of the condenser 2, of the pressure reducing valve 3, and of the evaporator 4, as well as the operation of the exchanger 7 which is short-circuited by a duct 53 which is installed parallel on the exchanger 7 and controlled by a valve 54.

Under such operating circumstances, we see that the liquid to be heated is heated basically inside the exchanger 11 then inside the exchanger 8, which is heated by the circuit of the solution that crosses the exchanger 10, the base of the column 14, the duct 29, the by-pass 53, the exchanger 8 and by returning to the exchanger 10 after having crossed the absorber 5 (which no longer acts as an absorber) and the return duct 45 by way of the circulation pump 6.

From the preceding description, it seems that the facility as designed according to the invention which uses simple and few instruments displays substantial flexibility in use, permits sizeable compactness in the assembly, and it enables the operation of the facility with switching on or off according to the most advantageous conditions for the absorbing cycle which acts as the heat pump. Aside from its operation which is associated to the heat pump, the facility makes it possible to obtain improved yields as compared with known facilities, as a result of better separation of distillates and residues which are produced in the absorbing cycle, thus enabling better yields for that cycle and better recovery of latent heat and vapor condensation that is also latent and condensation at the level of the absorbing cycle and especially of distillates inside the separation column 14 and inside the dephlegmator 16.

We claim:

1. A liquid heating system utilizing an absorption solution heat cycle comprising:

a burner having a substantially circular cylindrical combustion chamber;

a first heat exchanger having a common wall with said combustion chamber for admitting and heating an absorption solution;

a second heat exchanger heated by said burner and mounted in series with said first exchanger for admitting and heating a liquid;

a separation column having a vertical cylindrical shape located directly above said combustion chamber for separating, at separate outlets, said absorption solution into distillates and residues, said combustion chamber including a plurality of baffles placed horizontally to constitute a simplified plate column, said separation column further communicating with said first exchanger;

a panelling surrounding the combustion chamber for homogenizing the temperature of the solution to be regenerated in said separation column, said panelling being divided by a wall into a first and a second chamber, said first chamber admitting returns of said to be regenerated absorption solution before inserting the to be regenerated solution to said separation column, and said second chamber communicating directly with said absorption solution at the base of said column through at least one large opening for improving thermosiphon thermal exchanges; and a dephlegmator having an inlet connected to an outlet of said separation column for receiving the distillates for partial drying thereof, said dephlegmator further having an outlet connected to an inlet of said separation column for returning liquid parts of said distillates to said column.

2. A system according to claim 1 wherein said dephlegmator further comprises a cylindrical flask having at least one downward peripheral helical path for receiving said distillates, and wherein thermal exchange of heat occurs between said distillate and said liquid.

3. A system according to claim 2 wherein said flask comprises a first wall and a second inner wall creating a ring-like space between them and forming said helical path for receiving said distillates; the system further comprising a helical coil located in said ring-like space for receiving said liquid.

4. A system according to claim 3 further comprising a third heat exchanger and an absorbing unit, said third heat exchanger having one inlet connected to a second outlet of said separation column for receiving said residue, the third exchanger further having a second inlet connected to a first outlet of said absorbing unit for receiving said absorption solution in an opposite direction.

5. A system according to claim 4 further comprising a fourth heat exchanger having one inlet connected to one outlet of said third heat exchanger for receiving said residue and a second inlet connected to a second outlet of said absorbing unit for receiving said liquid.

6. A system according to claim 5 further comprising a bypass for short circuiting said third heat exchanger, said bypass being connected along a circulation path of said residues thereby selectively rendering said absorbing cycle of the system nonoperational.

7. A system according to claim 5 or 6 wherein said separation column, said third and fourth heat exchangers and said dephlegmator are surrounded by said first and second heat exchangers having the form of a helical coil and constituting a housing for said separation column, said third and fourth heat exchangers and said dephlegmator.

* * * * *

UNITED STATES PATENT AND TRADEMARK OFFICE

CERTIFICATE OF CORRECTION

PATENT NO. : 4,580,407

DATED : April 8, 1986

INVENTOR(S) : Christian Aime, et al.

It is certified that error appears in the above-identified patent and that said Letters Patent is hereby corrected as shown below:

Column 7, line 5, change "combustion chamber" to --separation column--.

Signed and Sealed this

Twenty-fourth Day of January, 1989

*Attest:*

DONALD J. QUIGG

*Attesting Officer*

*Commissioner of Patents and Trademarks*